United States Patent [19]

Herd et al.

[11] Patent Number: 4,750,724

[45] Date of Patent: Jun. 14, 1988

[54] APPARATUS FOR STACKING A ZIGZAG FOLDED WEB

[75] Inventors: Josef Herd, Münster; Kurt Gerbig, Otzberg; Reiner Pfuhl, Dieburg, all of Fed. Rep. of Germany

[73] Assignee: Maschinenfabrik Goebel GmbH, Darmstadt, Fed. Rep. of Germany

[21] Appl. No.: 43,854

[22] Filed: Apr. 29, 1987

[30] Foreign Application Priority Data

Apr. 30, 1986 [DE] Fed. Rep. of Germany .... 3614655

[51] Int. Cl.[4] ..... B41L 1/39

[52] U.S. Cl. ..... 270/39; 493/402; 493/407

[58] Field of Search ..... 101/32, 39–40, 101/5; 493/357, 400–403, 407, 409–410, 416, 417, 429–430, 441, 442, 464

[56] References Cited

U.S. PATENT DOCUMENTS

| | | | |
|---|---|---|---|
| 2,098,427 | 11/1937 | Menschner | 493/412 |
| 2,865,639 | 12/1958 | Gillette et al. | 493/410 |
| 3,178,172 | 4/1965 | Lettan | 493/411 |
| 3,640,521 | 2/1972 | Hutley | 493/412 |
| 3,717,335 | 2/1973 | Faltin . | |
| 3,889,940 | 6/1975 | Jakob . | |
| 4,205,836 | 6/1980 | Nystrand | 493/430 X |
| 4,410,315 | 10/1983 | Frye | 493/464 |
| 4,618,340 | 10/1986 | Meschi | 493/357 X |

FOREIGN PATENT DOCUMENTS

| | | |
|---|---|---|
| 611694 | 4/1935 | Fed. Rep. of Germany . |
| 7803900 | 1/1978 | Fed. Rep. of Germany . |
| 8509218 | 3/1985 | Fed. Rep. of Germany . |

*Primary Examiner*—Eugene H. Eickholt

*Attorney, Agent, or Firm*—Watson, Cole, Grindle & Watson

[57] ABSTRACT

An apparatus for stacking a zigzag folded web into piles includes means for directing the web folds into a fold stacking station and includes endless fold directing belts having a sloped run which tangentially contacts only the outer free edges of the folds being conveyed to the stacking station.

5 Claims, 1 Drawing Sheet

APPARATUS FOR STACKING A ZIGZAG FOLDED WEB

BACKGROUND OF THE INVENTION

This invention relates to an apparatus for stacking a zigzag foled web into piles of predetermined height after the web leaves a zigzag folding device. The web is conveyed edge wise to a pile stacking station, and means are provided for directing the folds of the web into a compact stack resting on a support surface of a vertically movable support at the station, the folds being so directed as to lie flat in the stacks being formed without the formation of intervening air cushions.

Known apparatus for the zigzag folding of webs of paper or other materials are normally connected directly to a printing machine, i.e. a printer for the production of forms from webs of indeterminant length. These folding apparatus fold a printed web of paper or other material so that the web can be bent along lines of perforations, disposed crosswise to the direction of travel. In this way a zigzag stack can be formed so that the individual parts of the web between the perforations are superimposed. The folding apparatus may include hoppers which move back and forth for folding the web along the crosslines of perforations into a zigzag stack. The web may comprise one or more superimposed layers of the same or different materials such as thicker or thiner paper. Whether imprinted or not, the zigzag stack will be fed for further processing such as through a high speed printer. During the zigzag folding operation, the web to be stacked is constantly moved back and forth by the folder against the air in its environment. This often leads to undesireable air streams which impede the formation of a flat folded stack particularly for thin and light webs as air is captured and pillows between the folds especially if the web is running at high speed. Moreover, the air bulges or pillowing between the folds may lead to an arched orientation of the stack as the overlying folds shift relative to one another during the folding operation. Thus, it becomes difficult to subsequently form the arched zigzag folded web into squared-off stacks.

U.S. Pat. No. 3,717,335 discloses a cross-web folder for zigzag folding of a web by means of rotating cams. However, since the cams contact surfaces of the folds during web folding, which surfaces may have already been imprinted, the quality of the imprint may be damaged by the rotating cams as by smudging or smearing.

German Pat. GM No. 78 03 900 discloses a web folding device having a conveyor on which the opposed lateral edges of the folded web are supported. Such a device is employed mainly for folding thick and heavy webs and is not adaptable for folding thin and lightweight webs which have a tendency to buldge due to aerodynamic forces.

German Pat. No. 611,694 discloses a folding apparatus for the zigzag folding of webs by means of a movable beater for pressing the folds together. These beaters also contact surfaces of the folds in those locations already imprinted or before printing in a following printing operation. Thus, if already imprinted, the web folds are smudged or smeared by the beaters, and moreover the beaters are incapable of being operated at high speeds (such as approximately 20 Hz) due to their inertia.

German Pat. GM No. 85 09 218 discloses an apparatus for stacking a zigzag folded web into piles including a laterally reciprocating plate 32 which, however, does not avoid or reduce the formation of air pillowing between the folds during stock formation.

SUMMARY OF THE INVENTION

It is therefore an object of the present invention to provide an apparatus for stacking a zigzag folded web into flat and compact piles without air bulging or pillowing between folds of even thin webs, thereby assuring the formation of squared-off stacks.

The present apparatus includes a conveyor for supporting a zigzag folded web edgewise and for conveying the web to a pile stacking station which is defined by forward and rearward sides and an upstanding, vertical movable support having a horizontal support surface. At least one endless rotating belt is provided for directing the web folds in flat overlying relationship on to the support surface between the stacking station sides, the belt having a run which slants from the forward side of the stacking station upwardly and rearwardly and partially overlies the support surface so as to define a constricted entry for directing the folds into the stacking station as the belt contacts only the outer edges of the folds. The belt extends about a plurality of spaced rollers, one of which is located outwardly of the forward side of the stacking station and in a horizontal plane which includes the top of the pile being formed. A rotatable roller brush is coaxial with the one roller and has bristles extending into the space between the sides of the stacking station for beating down the outer edges of the folds into the pile being formed.

Another roller brush may be mounted for rotation outwardly of the rearward side of the stacking station and in the same plane as the first roller, the second brush having bristles extending into the space between the sides of the stacking station for beating down into the pile the edges of the folds at such rearward side. A cutting device may be mounted adjacent the pile stacking station, the device having a cutter movable toward and away from the stacking station for separating the web into individual piles during stacking. The conveyor has at least one endless belt with an anti-slip surface supporting the edges of the web folds, and the fold directing belt may also have an anti-slip fold engaging surface.

DETAILED DESCRIPTION OF THE INVENTION

Figures 1, 2, 3, 4:
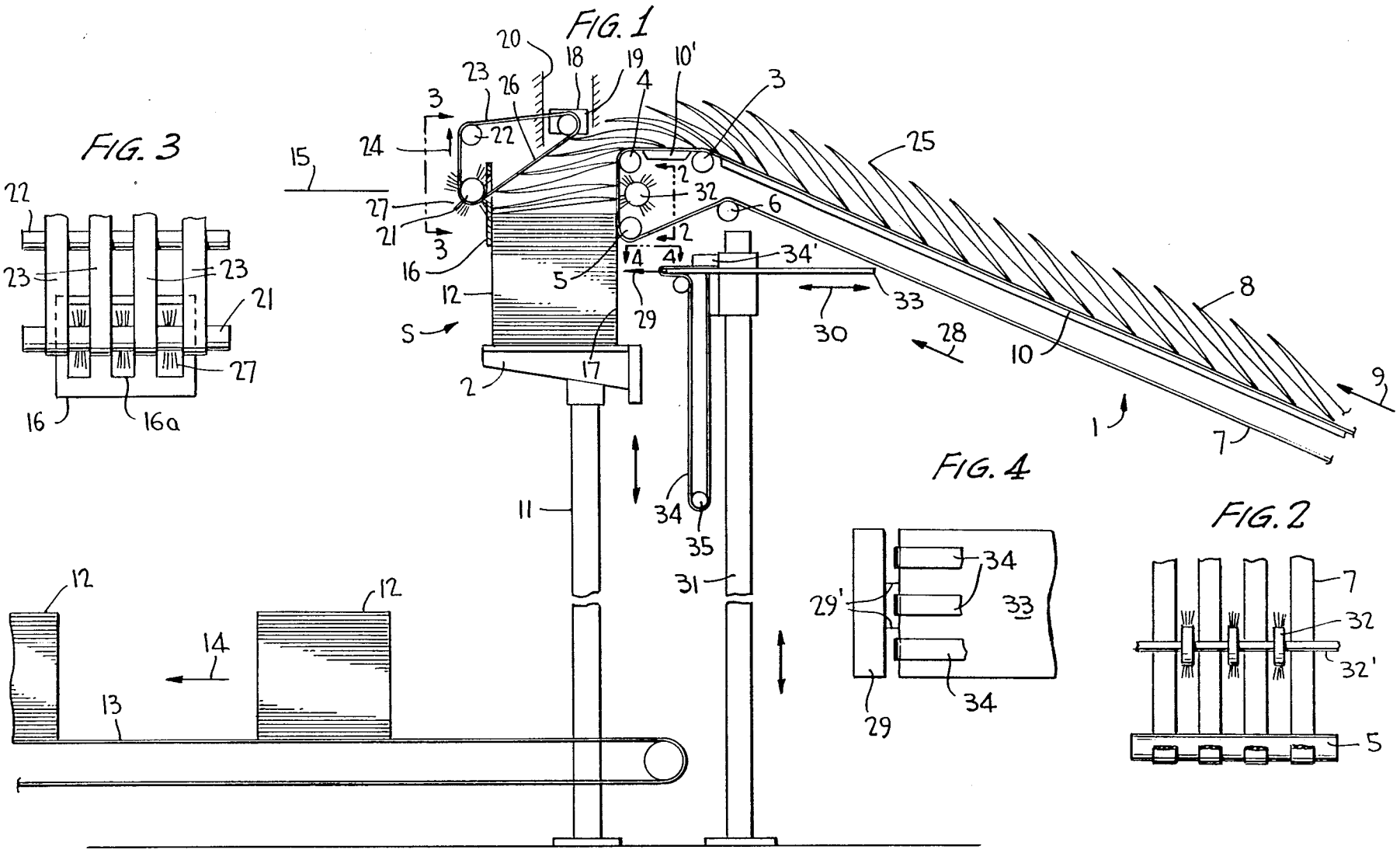
FIG. 1 is a schematic illustration of the apparatus according to the invention.
FIG. 2 is a view taken substantially along the line 2—2 of FIG. 1.
FIG. 3 is a view taken substantially along the line 3—3 of FIG. 1.
FIG. 4 is a view taken substantially along the line 4—4 of FIG. 1.

Turning now to the drawings wherein like reference characters refer to like and corresponding parts throughout the several views, the essential details forming the apparatus of the invention are illustrated in FIG. 1, although inessential details are not illustrated since they are believed known by those having skill on this art. Conveyor means, generally designated 1 in FIG. 1, is located generally downstream, in the direction of web travel, of a zigzag web folding apparatus which may be of the type disclosed in commonly owned U.S. Pat. No. 3,889,940. As will be explained in more detail hereinafter, the conveyor conveys the zigzag folded web edgewise to a pile stacking station in which includes a support 2 having a horizontal support surface. The conveyor includes a plurality of spaced guide rollers 3, 4, 5 and 6, and a further set of guide rollers (to the right in FIG. 1, but not shown) about which one endless conveyor belts 7 extend. As seen in FIG. 2, a plurality of transversely spaced conveyor belts 7 are provided. And, one of the guide rollers is driven by some suitable means (not shown) for moving the belts in the direction of arrow 9.

The outer surfaces of belts 7 are roughened or are otherwise rendered anti-slip. The conveyor further includes an upwardly sloping support plate 10 and a horizontal support plate 10', located between rollers 3 and 4, such that the conveyor belts overlie and are supported on these support plates and slide therealong during movement of the belts.

After leaving a zigzag folding apparatus (not shown), the zigzag folded web 8 is supported edgewise on the anti-slip surfaces of conveyor belts 7, and the folded web is conveyed as shown in the direction of arrow 9 toward a pile stacking station generally designated S and including support plate 2 of a verically movable support. The folds of the zigzag folded web have a tendency to lean forward toward the left as seen in FIG. 1 as the folded web proceeds toward the pile stacking station.

The conveyor belts have a vertical run as defined between spaced rollers 4 and 5 which thereby define a rearward side 17 of the pile stacking station. And, the present apparatus includes a fixed vertical wall 16 transversely spaced from the vertical run of the conveyor belts and forming a forward side of the pile stacking station.

Support plate 2 is mounted on/at upstanding post 11 which may be in the form of a screw jack, collapsible tube, or the like which, when operated by a suitable drive (not shown), is capable of being raised and lowered in the direction of the double arrow shown. Post 11 is positioned between a plurality of transversely spaced conveyor belts 13, and the width of support 2 is less than the space betwen these conveyor belts. Thus, the post may be lowered to the extent necessary to lower support 2 beneath the upper run of belts 13 so as to deposit a formed stack 12 of the folded web onto the upper run of belts 13 which are driven by suitable means (not shown) for conveying the stacks in succession in the direction of arrow 14 to another processing station. Although stacks 12 are shown of the same height resting on conveyor belts 13, they may be of different height after being formed at station S.

The upper end of the stack is defined at level 15, and mounted thereabove is a means for directing the folds of the web into a compact, flat pile resting on support 2 between sides 16 and 17. Such means include one or more transversely spaced, endless fold directing belts 23 movable in the direction of arrow 24 by a suitable drive (not shown), the belts having a run 26 which slants from fixed wall 16 upwardly and rearwardly and partially overlies support 2 so as to define a constricted entry for directing the web folds into the stacking station as belts 23 contact only outer edges 25 of the folds. The belts extend about spaced rollers 18, 21 and 22, roller 21 being located outwardly of fixed wall 16 and in a horizontal plane at level 15 of the pile being formed. Roller 18 is journalled in end pads 19 which are capable of being verically adjusted along fixed guide channels 20 for changing the slope of run 26, such adjustment being carried out in some suitable manner, not shown.

At least one of the guide rollers 18, 21, 22 is driven at a speed for matching the movement of belts 23 to the movement of conveyor belts 7 such that free ends 25 of the folds move at approximatey the same rate and in the same direction as belts 23. The drive of belts 23 can be provided with a differential or the like transmission so that the speed of movement of belts 23 can be altered or adjusted during operation.

The outer surfaces of belts 23 may be roughened or otherwise have anti-slip surfaces, and sloping run 26 of the belts tangentially contact free ends 25 of the folds for directing them into the stacking station without contacting any surface portion of the zigzag folds.

Roller brushes 27 are mounted on roller 21 for rotation together therewith, and are located between spaced belts 23, as shown in FIG. 3. The brushes have bristles extending through openings **16*a* of fixed plate 16 and into the space between plate 16 and the opposing side 17 of the station. The bristles may extend from the entire periphery of roller brush 27, or bristle segments (as shown) may extend from only portions of the periphery. The roller brushes rotate together with belts 23, and only the brush bristles serve to beat down outer edges 25 of the folds into the pile being formed at elevation 15**

Another set of roller brushes 32 (FIG. 2) are mounted on a common axle rod 32' which is rotated counterclockwise, when viewed in FIG. 1, by a suitable drive (not shown). Brushes 32 are located in the spaces between conveyor belts 7, and only the bristles of these brushes extend into the space between opposing sides 16 and 17 of the pile stacking station for beating down those edges of the folds opposite edges 12 into the pile being formed at elevation 15. Again, the bristles of brushes 32 (as shown) may extend from the entire periphery of the brushes, or bristle segments may extend from only spaced portions of the periphery. When the bristles of both sets of brushes 27 and 32 are segmented, they successively beat down the opposing edges of the folds so as to avoid any bulging or pillowing between overlying folds due to air pockets, thereby forming a compact and squared-off stack 12.

A cutting device, generally designated 28, is provided adjacent rearward side 17 of the stacking station, the device including a knife blade 29 mounted as at 29' (FIG. 4) to the forward end of a horizontal plate 33 capable of reciprocating by some suitable drive means (not shown) in the direction of double arrow 30. Plate 33 is mounted on an upstanding post 31 which may be formed as a screw jack, collapsible tube or the like capable of being raised and lowered in the direction of the double arrow shown. The cutting knife is mounted at the forward end of plate 33 by blade supports 32' located between a plurality of tapes 34 which are mounted at one end at 34' above plate 33, extend about the forward end of plate 33 and form a depending loop tensioned by a vertically movable roller 35.

Upon operation of the cutting device, knife 29 is shifted to the left and through the formed stack for cutting through one of the folds so as to separate the pile into a stack 12 at a predetermined height depending on the elevation of support 2 and the relative elevation of plate 33. A stack 12 is thus formed and separated from the overlying stack being formed. As the knife blade is moved to the left through the stack as aforesdescribed, plate 33 likewise moves tapes 34 through the stack behind the knife blade such that the length of the loop as shown diminishes but remains tensioned by roller 35. Thus, the tapes extending between sides 16 and 17 of the stack so as to support the overlying stack being formed until the previously formed stack is lowered onto conveyor 13 by operation of post 11, and support 2 is raised to underlie tapes 34, after which tapes 34 are withdrawn back to the position shown in FIG. 1.

From the foregoing, it can be seen that by operation of the present apparatus any air pillowing developed between folds of a zigzag folded web during folding is eliminated during stack forming as the fold edges are pressed into the stack upon engagement by belts 23 and the bristles of brushes 27, as well as by the bristles of brushes 32. Moreover, the surfaces of the zigzag folded web are not contacted during stack forming, so that any smudging or smearing of printed surfaces are completely avoided. And, folded webs of thin and light as well as thick and heavy materials are capable of being formed into stacks by practicing the invention.

What is claimed is:

1. Apparatus for stacking a zigzag folded web into piles, comprising a pile stacking station defined by forward and rearward sides and an upstanding, vertically movable support having a horizontal support surface, conveyor means for supporting the zigzag folded web edgewise and for conveying the web in a forward direction to said station, said conveyor means including at least one endless conveyor belt having a vertical run forming said rearward side at said station, a fixed vertical wall transversely spaced from said vertical run and forming said forward side at said station, means for directing the folds of said web on to said support surface between said sides without air pillowing between overlying folds so as to thereby form a squared-off stack, said directing means including at least one fold directing endless belt movable in a direction toward said fixed wall about a plurality of spaced rollers, said fold directing belt having a run which slants from said fixed wall upwardly and rearwardly and partially overlies said support surface so as to define a constricted entry for directing the folds into said stacking station as said fold directing belt contacts only the outer edges of the folds, one of said rollers being located outwardly of said fixed wall and in a horizontal plane including the top of a pile being formed, a first roller brush coaxial with said one roller and rotatable together therewith, said roller brush having bristles extending into the space between said sides of said station for beating down said outer edges of said folds into said pile being formed.

2. The apparatus according to claim 1, further comprising a second roller brush mounted for rotation outwardly of said vertical run and in said horizontal plane, said second brush having bristles extending into said space between said sides of said station for beating down into said pile edges of said folds opposite said outer edges.

3. The apparatus according to claim 1, further comprising a cutting device mounted adjacent said suppport and having a cutter movable toward and away from said station for separating said web into individual piles during stacking.

4. The apparatus according to claim 1, wherein said fold directing belt has an anti-slip fold engaging surface.

5. The apparatus according to claim 1, wherein said conveyor belt has an anti-slip surface supporting said opposite edges of said folds.

* * * * *